United States Patent [19]

Borsuk

[11] 4,011,028

[45] Mar. 8, 1977

[54] AXIAL-FLOW TRANSSONIC COMPRESSOR

[76] Inventor: Anatoly Nikolaevich Borsuk, ulitsa Metallurgov, 40, kv. 7, Moscow, U.S.S.R.

[22] Filed: Oct. 16, 1975

[21] Appl. No.: 623,012

[52] U.S. Cl. ..... 415/192; 415/199.5

[51] Int. Cl.[2] ..... F01D 1/02

[58] Field of Search ..... 415/181, 190, 191, 192, 415/194, 199 R

[56] References Cited

UNITED STATES PATENTS

| | | | |
|---|---|---|---|
| 1,997,506 | 4/1935 | Adamcikas | 415/192 |
| 2,224,519 | 12/1940 | McIntyre | 415/192 |
| 2,320,733 | 6/1943 | McIntyre | 415/192 |
| 2,378,372 | 6/1945 | Whittle | 415/181 |
| 2,384,000 | 9/1945 | Wattendorf | 415/181 |
| 2,505,755 | 5/1950 | Ganahl et al. | 415/192 |
| 2,623,688 | 12/1952 | Davidson | 415/181 |
| 2,663,493 | 12/1953 | Keast | 415/194 |
| 2,710,136 | 6/1955 | Ganahl et al. | 415/181 |
| 2,726,806 | 12/1955 | Keast | 415/194 |
| 3,024,967 | 3/1962 | Wilde et al. | 415/192 |
| 3,121,527 | 2/1964 | Jerie et al. | 415/193 |

*Primary Examiner*—Henry F. Raduazo
*Attorney, Agent, or Firm*—Holman & Stern

[57] ABSTRACT

An axial-flow transsonic compressor wherein a flow path is defined by a housing of the compressor and an inlet bladed stator, at least one transsonic stage and at least one subsonic stage, arranged within the housing in succession along the path of the flow of the fluid being compressed. The transsonic stage includes a transsonic rotor and a bladed stator. The subsonic stage includes a rotor and a stator. Each blade of the inlet stator structure has an angle of setting of a profile of a peripheral section perpendicular to a blade axis determined with respect to a vector of the circumferential speed of the transsonic rotor in excess of 90°; an angle of setting of a profile of a radially innermost or sleeve section perpendicular to the blade axis determined with respect to the vector of the circumferential speed of the transsonic rotor below 90° and an angle of setting of a profile of a middle section perpendicular to the blade axis determined with respect to the vector of the circumferential speed of the transsonic rotor substantially equalling 90°. The curvature of the middle line of a profile of the middle section equals zero. Each blade of the stator structure of the transsonic stage has a chord value increasing from a sleeve section profile toward a peripheral section profile.

2 Claims, 5 Drawing Figures

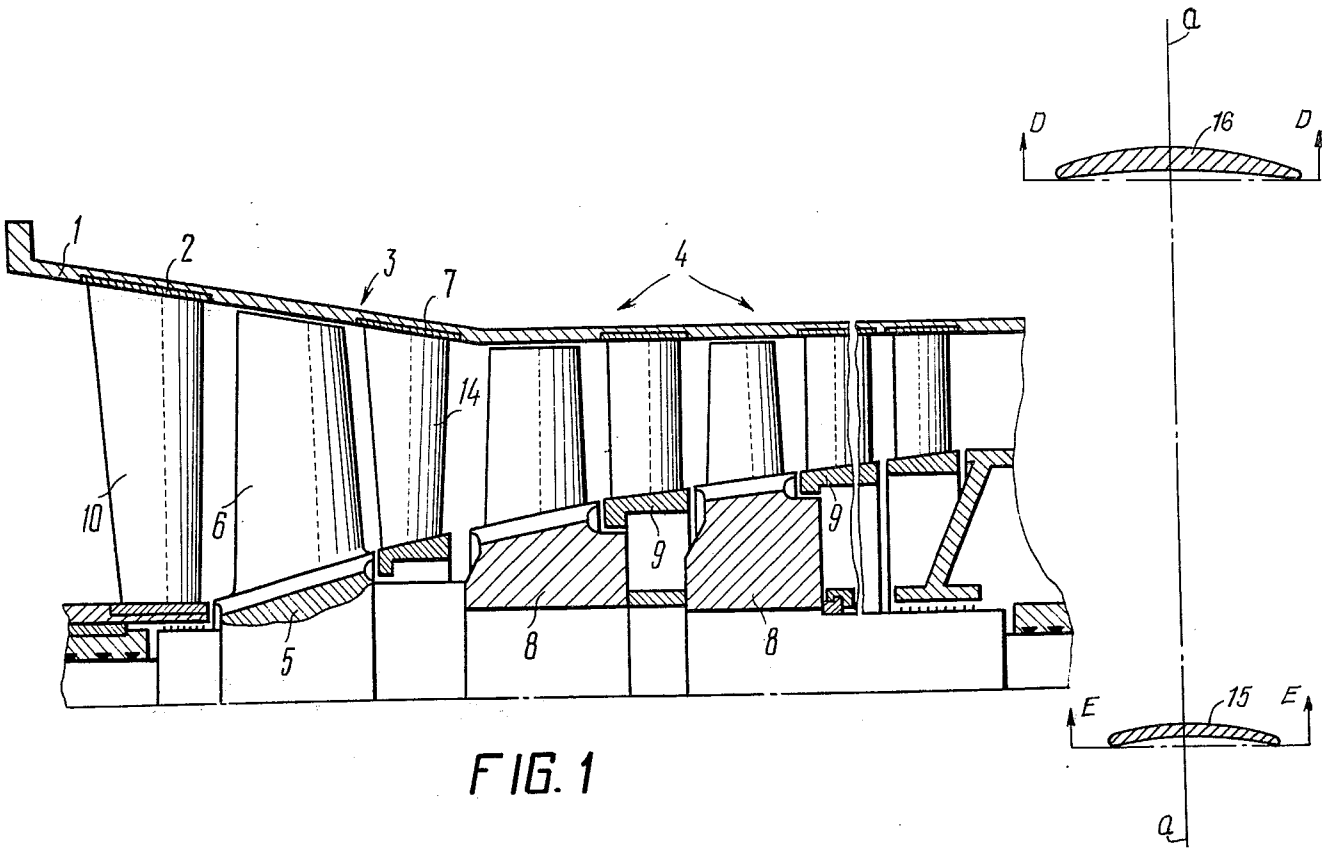
FIG. 5
FIG. 1
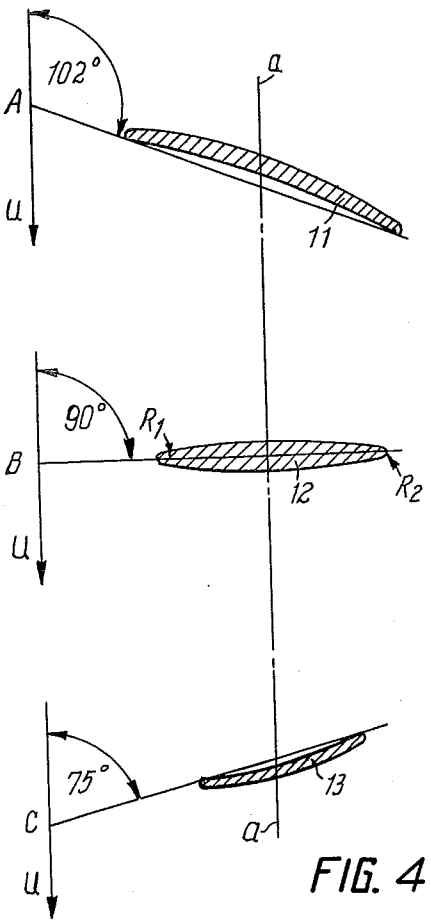
FIG. 4

AXIAL-FLOW TRANSSONIC COMPRESSOR

BACKGROUND OF THE INVENTION

The present invention relates to the art of compressor engineering and, more particularly, it relates to axial-flow transsonic compressors, preferably of the type incorporable in gas turbine plants.

The present invention is useful to utmost advantage in high-power stationary gas turbine plants operable with relatively high air flow rate, as high as 750 kg/sec and compressor shaft speeds of about 3000 rpm, the air at the intake of the compressor being under normal atmospheric pressure.

There is known in the prior art an axial-flow transsonic compressor adapted for incorporation in aircraft jet engines. The flow path or section of this prior art transsonic axial-flow compressor is defined by a housing of the compressor and a bladed intake stator structure, at least one transsonic compression stage and at least one subsonic compression stage, arranged within this housing in succession along the path of the fluid being compressed. The transsonic stage includes a transsonic rotor and a bladed stator structure.

The subsonic stage likewise includes a rotor and a stator structure.

However, the prior art axial-flow transsonic compressor has not found practical application in high-power gas turbine plants, either stationary or mobile, because of structural complications and complications arising from the requirements of high reliability and long life combined with high circumferential speed and high capacity, as well as from the desirability of ensuring a high efficiency factor of the axial-flow transsonic compressor.

SUMMARY OF THE INVENTION

It is an object of the present invention to improve the efficiency factor of a high-capacity axial-flow transsonic compressor operable with relatively great head values, in order to step up the capacity of the associated gas turbine plant, to improve the economy thereof and to reduce the cost of its operation.

In accordance with the aforesaid and other objects, the essence of the present invention resides in an axial-flow compressor wherein a flow path or section thereof is defined by the housing of a compressor and an inlet bladed stator structure, at least one transsonic compression stage and at least one subsonic compression stage, arranged in succession within this housing along the path of the fluid being compressed, the transsonic stage including a rotor and a bladed stator structure, the subsonic stage including a rotor and a stator structure, in which compressor, in accordance with the present invention, each blade of the bladed inlet stator structure has an angle of setting of a profile of a peripheral section perpendicular to a blade axis with respect to a vector of a circumferential speed of a transsonic rotor in excess of 90°, an angle of setting of a profile of a radially innermost or sleeve section perpendicular to the blade axis determined with respect to the vector of the circumferential speed of the transsonic rotor below 90° and an angle of setting of a profile of a middle section perpendicualar to the blade axis with respect to the vector of the circumferential speed of the transsonic rotor substantially equalling 90°, the curvature of a middle line of the profile of the middle section equalling zero, each blade of the bladed stator structure of the transsonic stage having a chord increasing in value from the sleeve section toward the peripheral section.

It is preferred that the middle section of each blade of the inlet stator structure should have equal radii of curvature of the inlet and outlet edges thereof.

The herein disclosed design of the blades of the inlet stator and of the blades of the stator structure of the transsonic stage provides an optimum compliance of the geometrical shape of the blades with the actual flow of the fluid being compressed. The blades of the inlet stator structure ensure optimum shaping of the flow of the compressed fluid at the inlet to the transsonic rotor throughout the entire length of each blade of the rotor. All sections of the blades of the transsonic rotor have optimum working conditions. In this way a maximum head is obtained at the transsonic rotor with minimal waste of energy in the flow; in other words, the compression ratio is stepped up, and the efficiency factor of performance of the transsonic rotor is increased. With each blade of the stator structure of the transsonic stage having its chord increasing in value from the innermost or sleeve section toward the peripheral section, there is attained maximum compliance of the flow of the compressed fluid downstream of the transsonic rotor, the inherent feature of this flow being the varying head along the height of the stator structure, with the rotor structure of the first-in-succession subsonic stage. In this way there is ensured an increased efficiency factor of the axial-flow transsonic compressor of a high capacity and high compression ratio, as a whole.

Should it be otherwise, i.e., should there be poor compliance of the geometrical shape of the blades of the inlet stator structure with the actual flow of the compressed fluid at the inlet to the transsonic rotor structure, there would be an increased loss of the energy of the flow at the transsonic rotor, with the resulting reduced head and efficiency factor; whereas poor compliance of the geometric shape of the blades of the stator structure of the transsonic stage with the actual flow of the compressed working fluid at the inlet to the rotor structure of the first subsonic stage would further increase the loss of the energy of the flow. The outcome would be a reduced efficiency factor of the performance of the compressor and a reduced compression ratio.

An axial-flow transsonic compressor constructed in accordance with the present invention, e.g., intended for compressed-fluid supply of a high-power gas turbine plant, offers a capacity of 750 kg/sec at 3000 rpm of the rotor shaft, with normal atmospheric intake conditions, the efficiency factor of its performance being 1.5 to 2.0 percent higher than that of the prior art axial-flow transsonic compressors. This provides a higher power output, improved economy and reduced operational costs of high-power gas turbine plants.

Other objects and advantages of the present invention will be made apparent in the following description of an embodiment thereof, with reference to the accompanying drawings, wherein:

BRIEF DESCRIPTION OF THE DRAWINGS

FIG. 1 is a schematic axial sectional view of an axial-flow transsonic compressor embodying the invention;

FIGS. 4 A–C illustrates the respective profiles of the blades of the inlet stator at A—A, B—B and C—C of FIG. 2; and FIGS. 5 D+E illustrates the respective profiles of the blade of the stator structure of the transonic stage at D—D and E—E of FIG. 3.

DETAILED DESCRIPTION OF THE PREFERRED EMBODIMENT

Figure 2:
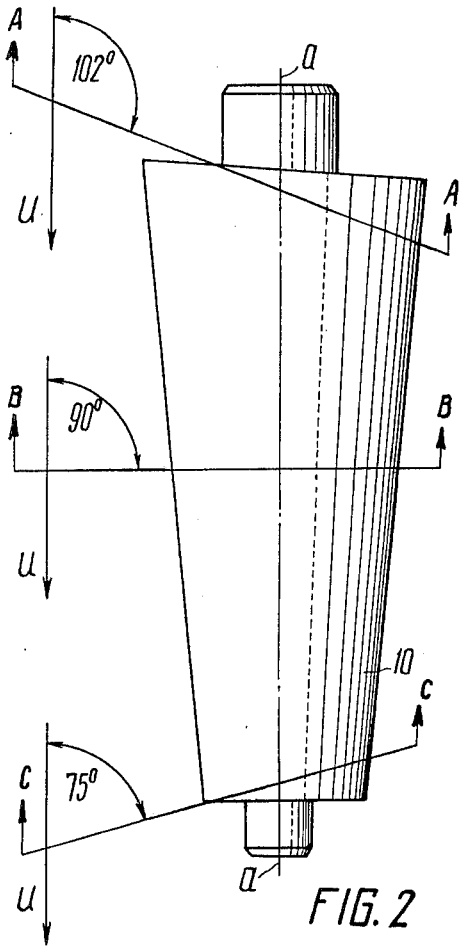
FIG. 2 illustrates the blade of the inlet stator structure showing respective angles of setting of profiles of sections, in accordance with the invention.
Figure 3:
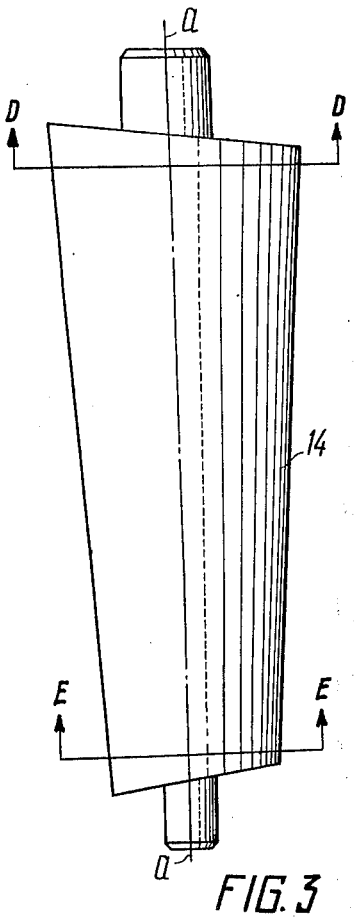
FIG. 3 illustrates the blade of the stator structure of the transsonic stage with respective angles of sections, in accordance with the invention.

In the axial-flow transsonic compressor constructed in accordance with the invention and intended for incorporation in high-power gas turbine plants requiring a relatively great flow rate of air, as high as 750 kg/sec at 3000 rpm of the compressor shaft and normal atmospheric pressure at the intake, the flow part or section being defined by a housing 1 (FIG. 1) of the compressor and a bladed inlet stator structure 2 having a blade 10, a single transsonic compression stage 3 and a series of subsonic compression stages 4, positioned in the housing 1 and arranged in succession along the flow of the air through the compressor. The transsonic stage 3 includes a transsonic rotor structure 5 having blades 6 and a bladed stator structure 7 having a blade 14. Each subsonic compression stage 4 includes a rotor structure 8 and a stator structure 9. Each blade 10 of the inlet stator structure 2 is characterized by an angle of setting of a profile 11 (FIG. 2) of a peripheral section thereof, which section is perpendicular to an axis $a - a$ of the blade. The angle of setting is determined with respect to a vector $u$ of the circumferential speed of the transsonic rotor 5 (FIG. 1) and is in excess of 90°, e.g. equalling 102° (FIG. 2). The blade is further characterized by an angle of setting of the profile 12 of a middle section, which section is perpendicular to the blade axis $a - a$. The angle of setting is determined with respect to the vector $u$ of the circumferential speed of the rotor 5 (FIG. 1) and is substantially equal to 90° (FIG. 2), the curvature of the middle line of the profile 12 equalling zero. The blade being still further characterized by an angle of setting of a profile 13 of a sleeve or radially innermost section which is perpendicular to the blade axis $a - a$. The angle of setting is determined with respect to the vector $u$ of the circumferential speed of the transsonic rotor 5 (FIG. 1) is less than 90°, e.g. equalling 75° (FIG 2). The profile 12 (FIG. 4) of the middle section of the blade 10 has equal radii $R_1$ and $R_2$, respectively, of curvature of the inlet and outlet edges thereof. The herein disclosed shape of the blades 10 of the inlet stator structure 2 (FIG. 1) has been found to ensure optimal shaping of the flow of the air being compressed at the inlet to the transsonic rotor 5 throughout the entire length of each blade 6 thereof. Each blade 14 (FIG. 1) of the stator structure 7 of the transsonic stage 3 has its chord increasing in value from a profile 15 (FIG. 5) of a sleeve or radially innermost section perpendicular to the blade axis $a - a$ toward a profile 16 of the peripheral or outermost section perpendicular to this axis $a - a$.

The herein disclosed shape of each blade 14 has been found to ensure optimum compliance of the flow of the compressed air downstream from the transsonic rotor 5 (FIG. 1) with the rotor 8 of the first subsonic stage 4.

The herein disclosed axial-flow transsonic compressor operates, as follows.

As the transsonic rotor 5 and the rotors 8 of the respective subsonic stages 4 are set into rotation, the air is drawn in through the inlet bladed stator structure 2 wherein the flow of the air being compressed is shaped. This flow is directed to the rotor 5 of the transsonic stage 3 wherein at least at one of the sections of the blades 6, e.g., at the peripheral section, the speed of the air flow exceeds that of sound. All the sections of the blade 6 of the transsonic rotor 5 are operating under optimum conditions. At the rotor 5, rotor rotation mechanical energy is converted into potential energy air flow, whereby the air pressure is built up downstream of the rotor 5.

The blades 10 of the inlet stator structure 2 of the herein disclosed compressor provide an optimum shaping of the air flow at the inlet of the transsonic rotor 5 and throughout the length of each blade 6 of the rotor. All the profiles of the sections of the blades 6 of the transsonic rotor 5 are operating under optimum conditions. In this way, a maximal head is obtained at the transsonic rotor 5 with minimal loss of energy in the air flow, i.e., the compression ratio is stepped up, and the efficiency factor of performance of the transsonic rotor 5 is improved.

Downstream of the transsonic rotor 5 the air flow gets to the blades 14 of the stator structure 7 of the transsonic stage 3.

It is commonly known that the value of the efficiency factor of performance of a compression stage is defined by the energy losses caused by friction and formation of eddy currents, as the air flows about the surface of a blade, as well as by losses connected with the three-dimensional characteristic of the flow. The herein disclosed geometrical shape of the blade 14 of the stator structure 7 provides optimum compliance of the air flow downstream of the transsonic rotor 5, the inherent feature of this flow being the head varying along the height of the blade 14, with the rotor 8 of the first-in-succession subsonic stage 4, which minimizes the degree of formation of eddy currents and reduces the overall losses across the subsonic stages 4 wherein the energy of the flow is further built up.

The blades 10 of the inlet stator structure 2 and the blades 14 of the stator structure 7 of the transsonic stage 3, constructed in accordance with the invention, ensure optimum compliance of the geometrical shape of these blades 10 and 14 with the actual air flow, which yields an increased efficiency factor of the performance of the high-capacity axial-flow transsonic compressor.

What I claim is:

1. An axial flow transsonic compressor comprising: a compressor housing; an inlet bladed stator structure; at least one transsonic compression stage and at least one subsonic compression stage; said inlet bladed stator structure, said transsonic compression stage and said subsonic compression stage being arranged within said compressor housing, in succession along the flow path of the compressed fluid through said compressor and defining the flow section thereof, said transsonic stage comprising a transsonic rotor and a bladed stator structure, said bladed stator structure being mounted downstream along the path of the compressed fluid from said transsonic rotor, said subsonic stage comprising a subsonic rotor and a stator structure; said inlet bladed stator structure comprising blades each having a peripheral section perpendicular to the blade axis, a radially innermost section perpendicular to the blade axis and a middle section perpendicular to the blade axis, the angle of setting of a profile of said peripheral section, determined with respect to a vector of the circumferential speed of said transsonic rotor being in excess of 90°, the angle of setting of a profile of said radially innermost section determined with respect to the vector of the circumferential speed of said transsonic rotor being less than 90°, and the angle of setting of a profile of said middle section, determined with respect to the vector of the circumferential speed of said transsonic rotor substantially equalling 90°, said profile of said middle section having a middle line with a curvature equalling zero, said stator structure of said transsonic stage comprising blades each having a radially innermost section and a peripheral section, and having a chord increasing in value from a profile of said radially innermost section toward a profile of said peripheral section.

2. An axial-flow compressor as set forth in claim 1, wherein said profile of the middle section of said blade of said inlet stator structure has equal radii of curvature of the inlet and outlet edges thereof.

* * * * *